US005990844A

United States Patent [19]

Dumont et al.

[11] Patent Number: 5,990,844

[45] Date of Patent: Nov. 23, 1999

[54] RADIATING SLOT ARRAY ANTENNA

[75] Inventors: Bernard Dumont; Jean Chambrun, both of Paris; Bernard Perrier, Viry Chatillon; Jacques Rocquencourt, Cormeilles En Parisis, all of France

[73] Assignee: THOMSON-CSF, Paris, France

[21] Appl. No.: 09/096,178

[22] Filed: Jun. 12, 1998

[30] Foreign Application Priority Data

Jun. 13, 1997 [FR] France ..... 97 07354

[51] Int. Cl.[6] ..... H01Q 13/10

[52] U.S. Cl. ..... 343/770; 343/771; 29/600

[58] Field of Search ..... 343/770, 771, 343/767, 768, 700 MS; 29/600; H01Q 13/10

[56] References Cited

U.S. PATENT DOCUMENTS

| | | | |
|---|---|---|---|
| H680 | 9/1989 | Alfing et al. | 343/785 |
| 3,604,012 | 9/1971 | Lindley | 343/771 |
| 3,701,162 | 10/1972 | Seaton | 343/771 |
| 3,949,405 | 4/1976 | Roquencourt | 343/771 |
| 3,950,204 | 4/1976 | Williams . | |
| 4,255,752 | 3/1981 | Noble et al. | 343/771 |
| 4,581,614 | 4/1986 | LaCourse | 343/771 |
| 5,337,065 | 8/1994 | Bonnet et al. | 343/767 |

FOREIGN PATENT DOCUMENTS 2 180 523 11/1973 France .

OTHER PUBLICATIONS

Patent Abstracts of Japan, vol.15, No. 315, (E–1099), Aug. 12, 1991 and JP 03 117002 A, May 17, 1991.

*Primary Examiner*—Hoanganh Le

*Attorney, Agent, or Firm*—Oblon, Spivak, McClelland, Maier & Neustadt, P.C.

[57] ABSTRACT

This radiating slot array antenna is made out of a printed circuit sandwich structure with: a radiating plate in printed circuit form transparent to microwaves having, on its upper face, a metallization plane in which there are etched alignments of radiating slots; chutes made of a plastic material with a metallized inner wall, the chutes having their hollow part before the upper face of the radiating plate, being soldered by their edges to the metallization plane of the upper face of the radiating plate on and parallel to the alignments of radiating slots so as to overlap them, and reconstituting the three missing walls of waveguides whose fourth wall is constituted by the metallization plane etched with radiating slots of the upper face of the radiating plate; and an upper plate assembled on the back of the chutes to ensure the stiffness of the antenna. Its composition as a sandwich of printed circuits gives it high rigidity, great lightness and a low cost price.

12 Claims, 4 Drawing Sheets

RADIATING SLOT ARRAY ANTENNA

BACKGROUND OF THE INVENTION

1. Field of the Invention

The present invention relates to the antennas formed by an array of radiating slots made in a wall of a set of microwave signal feeder or collector waveguides positioned side by side. Antennas of this kind are well known in the prior art especially for their ability to be aimed by phase shifts or frequency variation of the microwave signals travelling through their waveguides.

A radiating slot array antenna usually has an entirely metal structure that makes it complicated and therefore costly to manufacture. This entirely metal structure also makes the antenna heavy and therefore difficult to carry and use in mobile equipment mounted on aircraft or land vehicles. It is also difficult for such an antenna to be simply carried by individuals.

2. Description of the Prior Art

There is a known way described in the French patent application FR-A-2.722.337 (THOMSON-CSF) of making slotted waveguides out of a thermoplastic material transparent to microwaves. These waveguides are lined, on the inner wall of their conduit, with a metal skin in which the radiating slots are etched. This technique for making radiating slotted waveguides is used to obtain a lighter material that costs less but is not directly usable for radiating slot array antennas for there arise problems of stiffness of the waveguide assembly supporting the radiating slots. These problems imply the use of a rigid frame that is heavy and bulky.

The idea of making waveguides without slots out of a conduit made of a plastic such as rigid polyvinyl chloride or a stratified polyester, with a metallized inner wall, has also been known much earlier from the French patent FR-A-1.436.490 (GEOFFROY-DELORE).

The present invention is aimed at providing a low-mass and low-cost radiating slot array antenna. A reduction of mass as compared with the standard approach using metal has indeed many advantages. It leads to additional gains in mass on the antenna support and especially on its motor and servomechanism when the antenna is mobile. It also makes it possible to envisage mounting the antenna on a light vehicle or even equipping an individual therewith.

SUMMARY OF THE INVENTION

An object of the invention is a radiating slot array antenna having a sandwich structure with:

- a radiating plate in printed circuit form transparent to microwaves having, on its upper face, a metallization plane in which there are etched alignments of radiating slots,
- chutes made of a plastic material with a metallized inner wall, said chutes having their hollow part before the upper face of the radiating plate, being soldered by their edges to the metallization plane of the upper face of the radiating plate, on and parallel to the alignments of radiating slots so as to overlap them, and reconstituting the three missing walls of waveguides whose fourth wall is constituted by the metallization plane etched with radiating slots of the upper face of the radiating plate, and
- an upper plate assembled on the back of the chutes to ensure the stiffness of the antenna. Advantageously, the chutes are obtained by the deformation under heat of sheets of thermoplastic composite material lined on one face with a metal skin.

Advantageously, the chutes result from the deformation under heat of thermoplastic composite material lined, on one face, with a metal skin.

Advantageously, the metallizations of the radiating plate and of the chutes are copper metallizations and the soldering of the chutes to the radiating plate is done between metallizations by means of a network of indium-lead brazing strips deposited on the metallization plane of the upper face of the radiating plate in the zones facing the edges of the chutes.

Advantageously, the upper plate as well as the chutes are made of a thermoplastic material and are joined by simple pressure at a temperature close to the softening point of the thermoplastic material.

Advantageously, the upper plate is a printed circuit with one or more layers of conductors on which there are mounted components of an electronic circuit connected to the antenna.

Advantageously, the radiating plate has, on its outer face, opposite its upper face supporting the metallized plane etched with radiating slots, other zones of metallization that go round the radiating slots and form patterns of wiring conductors enabling the biasing of diodes placed across the slots to control their electrical length.

BRIEF DESCRIPTION OF THE DRAWINGS

Other features and advantages of the invention shall emerge from the following description of an exemplary embodiment. This description shall be made with reference to the drawings, of which.

MORE DETAILED DESCRIPTION

Figure 1:
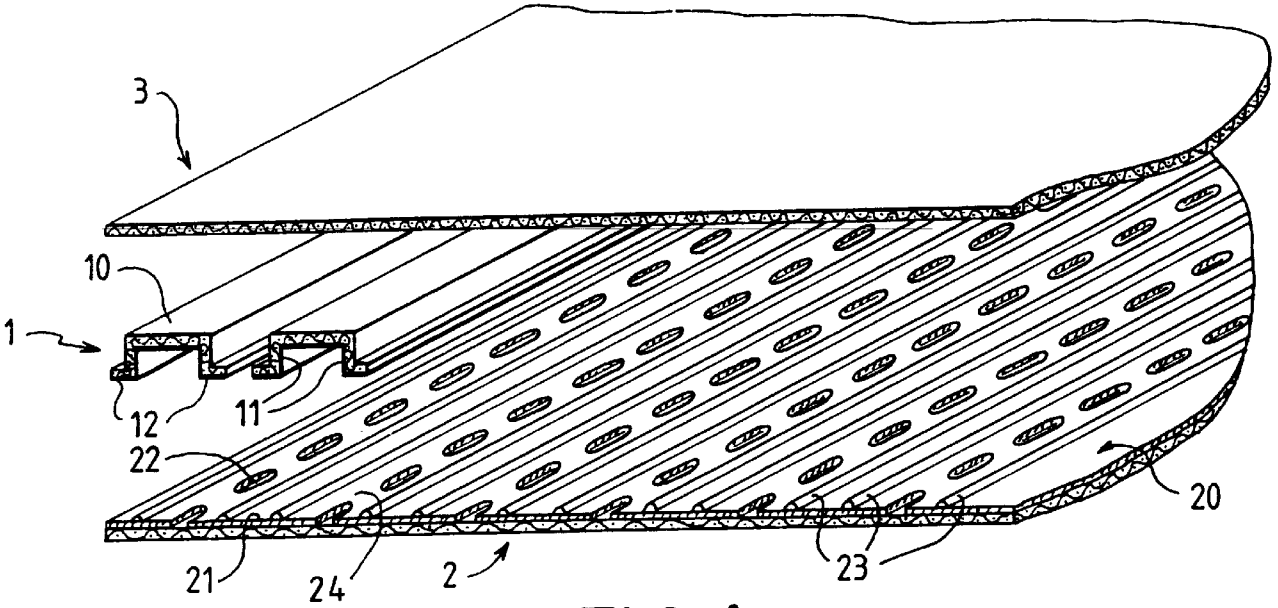
FIG. 1 shows an antenna according to the invention seen in a partial and disassembled view in perspective.
Figure 2:
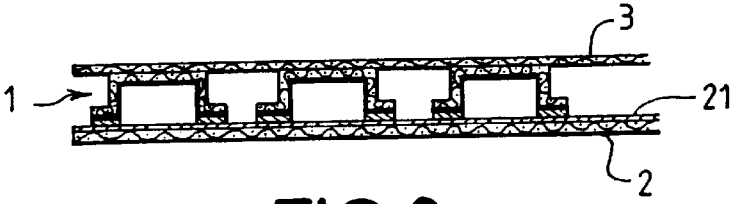
FIG. 2 is a partial cross-sectional view of the antenna shown in FIG. 1.
Figure 3A:
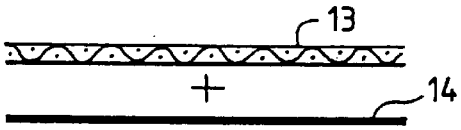
FIG. 3 illustrates the main steps of manufacture of an antenna according to the invention.
Figure 3B:
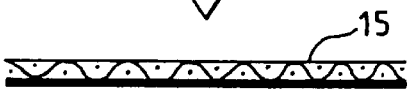
Figure 3C:
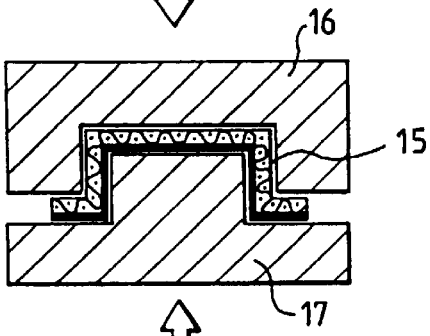
Figure 3D:
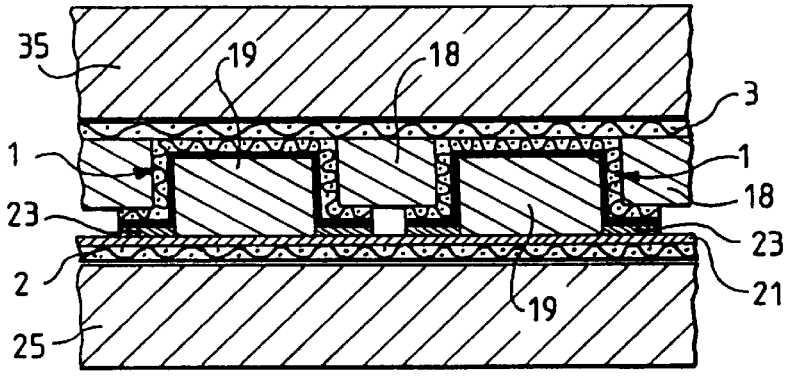

The radiating slot array antenna that will be described has a structure formed by the sandwiching of waveguide-demarcating chutes 1 between a lower radiating plate 2 turned towards the apertures of the chutes 1 and an upper stiffening plate 3.

The radiating plate 2 is a printed circuit made of a material transparent to microwaves with, on its upper face 20, a copper metallization plane 21 etched with several alignments of slots 22 and with a set of metallizations on its lower face constituting conductive tracks winding their way between the slots 22. A network of indium-lead brazing strips 23 is deposited on the metallization plane 21 of the upper face 20 of the radiating plate 2, so that the strips 23 are parallel to the alignments of slots 22 and positioned in pairs between each slot alignment. This network, in the metallization plane 21 of the upper face 20 of the radiating plate 2, demarcates metallization bands 24 each centered on an alignment of slots 22 and each corresponding to one of the metallized internal walls of a waveguide whose other three metallized internal walls take the form of a chute 1.

The chutes 1 have an inner wall with a copper metallization. They have a flat-bottomed U-shaped cross-section 10 with fins 11 having edges 12 flanged horizontally outwards. The spacing between the flanged edges 12 of the fins of the U-shape corresponds to that between two indium-lead brazing strips 23 which laterally border an alignment of slots 22. The chutes are constituted, for example, by a thermoplastic sheet metallized on one face and shaped by deformation under heat. Each of them is positioned before an alignment of slots 22 on the metallization plane 21 of the upper face 20 of the radiating plate 2, with its aperture turned so as to be facing the metallization plane 21 of the upper face 20 of the radiating plate 2, in such a way as to overlap an alignment of slots 22 and have its flanged edges 12 come into contact with two indium-lead brazing strips 23. Once soldered to the metallization plane 21 of the radiating plate 2 by the hot-pressing of its flanged edges 12 to the indium-lead brazing strips 23, each chute 21 forms a radiating slot waveguide with the band 24 of the metallization plane 21 of the upper face of the radiating plate 2 that closes its aperture.

Figure 4:
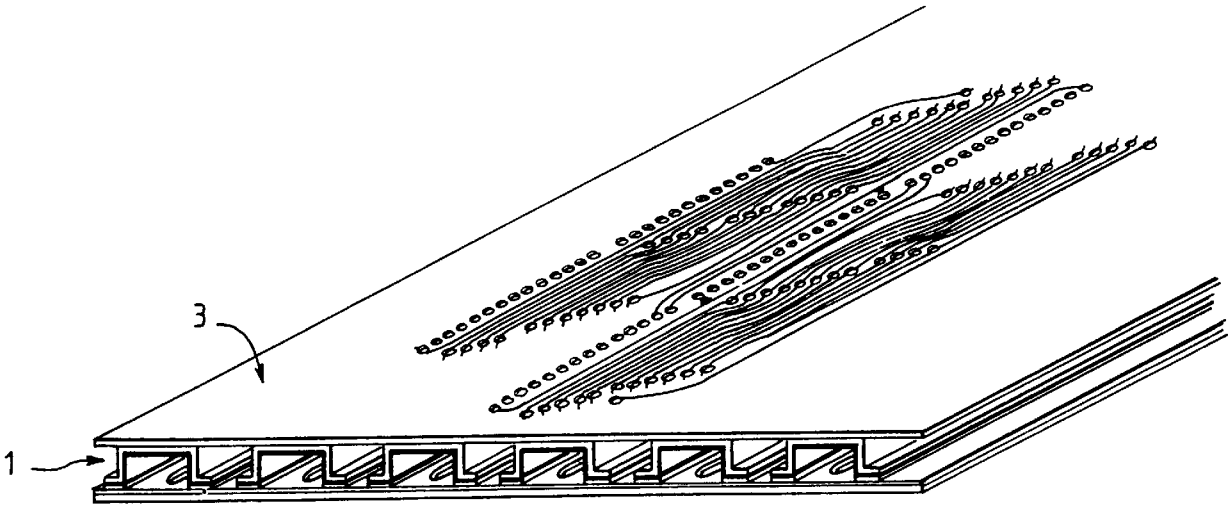
FIG. 4 is a rear view in perspective of the antenna shown in FIG. 1 after it has been assembled.

The stiffening plate 3 is fixed to the back of the chutes 1 in order to form a sandwich structure with these chutes 1 and the radiating plate 2, greatly reducing the flexibility of the radiating plate and giving the antenna high rigidity. It may be formed by a sheet made of thermoplastic composite material soldered to the back of the chutes by hot-pressing. Advantageously, as shown in FIG. 4, it is a multiple-layer printed circuit capable of supporting electronic components on its face exterior to the antenna.

FIG. 3 illustrates the main steps of manufacture of an antenna, with:

at a) the joining of a woven thermoplastic composite sheet 13 such as those used in the manufacture of printed circuits and a thin copper sheet 14 by simple hot-pressing at a temperature close to the softening temperature of the thermoplastic composite material, at b) the stratified sheet 15 obtained, at c) the chute obtained by shaping by means of the hot-pressing of the stratified sheet 15 between the jaws 16 and 17 of a template, and at d) the assembling of the sandwich structure of the antenna by holding its elements in position by means of the template bars 18 and 19 precisely positioned on the upper face of the radiating plate by means of centering pins and holes (not shown) placed at the end of the template bars 18 and 19 and the soldering and bonding of the positioned elements by hot-pressing between two jaws 25, 35 at a temperature greater than the melting temperature of the indium-lead brazing, close to the softening temperature of the thermoplastic material constituting the chutes.

The waveguides of the antenna are closed at their ends by short-circuits and appropriate charges preventing reflection. The short-circuits at the end of the waveguides may be obtained for example by means of a flat layer of metal wires positioned transversely between the two large faces of the guide and soldered through metallized holes. They may also be obtained by means of an end wall of a chute metallized on its internal face. An end cross-wall of this kind is then made and shaped in the same way as the side walls of the chute 11. This last-named approach may help in the tight sealing of the waveguides.

The excitation of the waveguides may be done by means of probes plunging into their conduit through apertures made in the chutes 1, starting from the stiffening plate 3. This excitation can also be done by means of a feeder waveguide positioned perpendicularly to the antenna waveguides on the external face of the stiffening plate 3. This feeder waveguide would then be made by means of the same technology as the antenna waveguides themselves, namely by means of a chute and a plastic material with a metallized interior wall soldered by its flanged edges to a metallized band etched with slots on the outer face of the stiffening plate 3. These slots face apertures made in the metallization of the chutes 1.

Figure 5:
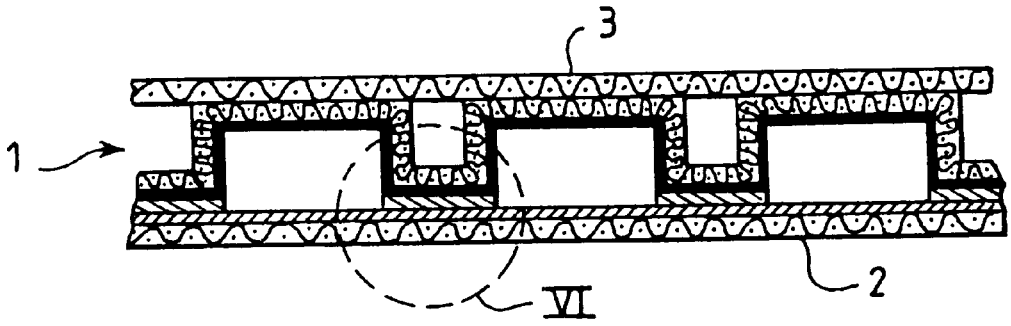
FIG. 5 is a partial cross-sectional view of a variant of an antenna according to the invention having a particularly small spacing between waveguides.
Figure 6:
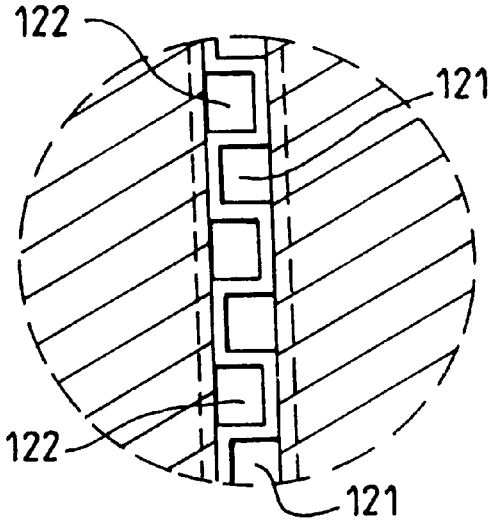
FIG. 6 is a detailed view of an antenna portion encircled at IV in FIG. 5, showing a particular contour adopted for the flanged edges of chutes used for the making of a waveguide array in the antenna.

FIGS. 5 and 6 give a detailed view of a variant used to reduce the distance between the waveguides of the antenna. According to this variant, the chutes 1 have flanged edges 12 that are crenellated and take the form of a sequence of legs 121, 122 with a spacing between them. Through the shape and an appropriate longitudinal offset of their respective legs 121, 122, the flanged edges 12 of two neighboring chutes 1 may be nested in each other, their legs being placed between each other. The amount of space that they require is thus greatly reduced. This is an advantage when it is sought to bring the alignments of radiating slots closer together to obtain a spread that is less than half of the wavelengths used, ensuring an absence of array lobes.

Figure 7:
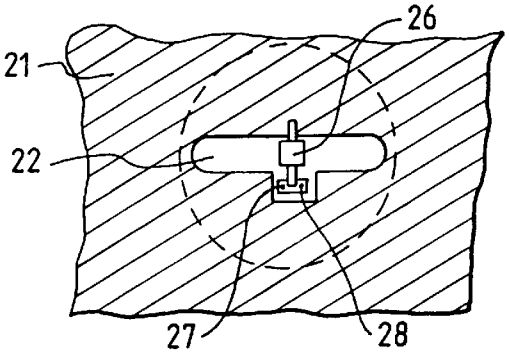
FIG. 7 is a detailed view of FIG. 4 illustrating a possible configuration for a radiating slot of the antenna.

FIG. 7 gives a detailed view of a radiating slot 22. This slot 22 is straddled in its middle by a short-circuit diode 26 enabling the adjustment of its electrical length. The diode 26 is connected by one side to the metallization plane 21 of the radiating plate 2 and by the other side to a connection zone 27. This connection zone 27 is isolated from the metallization plane 21 of the radiating plate 2 but is in contact by a metallized cross-piece 28 with a conductive track. This conductive track is traced on the lower face of the radiating plate 2 and winds its way between the radiating slots 22 towards one or more connectors placed on the edge of the radiating plate 2 centralizing the biasing controls of the diodes.

As a variant, it is possible to fill the inside of the chutes 1 with a solid dielectric material such as a foam so as to improve the resistance of the antenna 1 to the aggressive effects of the environment (humidity etc.). This solid dielectric filling has the advantage of further improving the stiffness of the antenna. It may be placed before the antenna parts are assembled and form a tooling element that is not removed, or it may be introduced afterwards, for example by the expansion of a foam or the introduction of a bar made of dielectric material.

FIG. 1, which pertains to a making of the antenna by means of chutes 1 with non-crenellated flanged edges 12, shows a double strip of indium-lead brazing 23 between each alignment of radiating slots 22. This double strip may obviously be replaced by a single broader strip.

As we have seen, the different elements forming the sandwich structure of the antenna: the radiating and stiffening plates as well as the chutes form part of the technology of printed circuits. Like the printed circuits, they are formed by woven or unwowen sheets of dielectrical materials, often based on fiber composites of thermoplastic or thermohardening glass-resin, lined if need be with a metallization. In the description of the embodiment, it has been assumed that the sheets used are based on thermoplastic resin with the quality of self-bonding under heat. Hence, no mention has been made of the use of bonder during the assembling. However, it is possible to use bonders during assembling to improve the adhesion between layers or quite simply to obtain adhesion between layers when the resin used is not thermoplastic but simply thermohardening.

In the same way, only copper-based metallizations have been mentioned but it is clear that metallizations based on other materials may be envisaged, especially those based on all the metals and alloys used in microwave applications.

What is claimed is:

1. A radiating slot array antenna having a sandwich structure with:

a radiating plate in printed circuit form transparent to microwaves having, on its upper face, a metallization plane in which there are etched alignments of radiating slots, chutes made of a plastic material with a metallized inner wall, said chutes having their hollow part facing the upper face of the radiating plate, being soldered by their edges to the metallization plane of the upper face of the radiating plate, on and parallel to the alignments of radiating slots so as to overlap them, and reconstituting the three missing walls of waveguides whose fourth wall is constituted by the metallization plane etched with radiating slots of the upper face of the radiating plate, and an upper plate assembled on the back of the chutes to ensure the stiffness of the antenna.

2. An antenna according to claim 1, wherein said chutes have crenellated, flanged edges forming a sequence of longitudinally spaced-out legs, the respective legs of the flanged edges facing two chutes placed side by side being offset with respect to each other so that they can be nested in each other and reduce the spacing between chutes.

3. An antenna according to claim 1, wherein said chutes are filled with a solid dielectric material.

4. An antenna according to claim 1, wherein said chutes are closed at their ends by a flanged wall.

5. An antenna according to claim 4, wherein said flanged wall is lined on its inner face with a metal skin and constitutes an electrical short-circuit for the waves.

6. An antenna according to claim 1, wherein said chutes are fitted out at their ends with a transversal, plane layer of metal wires joining their bottom to the upper facing wall of the radiating plate and constituting an electrical short-circuit for the waves.

7. An antenna according to claim 6, wherein the joining of the upper stiffening plate to the back of the chutes is done by simple pressure under heat, at a temperature close to the softening point of the thermoplastic material.

8. An antenna according to claim 1, wherein the chutes result from the deformation under heat of sheets of thermoplastic composite material lined, on one face, with a metal skin.

9. An antenna according to claim 1, wherein the metallizations of the radiating plate and of the chutes are copper metallizations and wherein the soldering of the edges of chutes to the radiating plate is done between metallizations by means of a network of indium-lead brazing strips deposited on the metallization plane of the upper face of the radiating plate in the zones facing the edges of the chutes.

10. An antenna according to claim 1, with short-circuit diodes placed straddling the radiating slots so as to control their electrical length, wherein the lower face of the radiating plate is provided with conductive tracks that wind their way between the radiating slots from the edges of each radiating slot to the edges of the radiating plate to centralize the biasing commands of said short-circuit diodes.

11. An antenna according to claim 1, wherein the upper stiffening plate is a printed circuit bearing electronic components on its face external to the antenna.

12. An antenna according to claim 1, wherein the chutes are constituted by a sheet made of composite thermoplastic glass-resin fibers coated on one face with a metal sheet and deformed under heat.

* * * * *

UNITED STATES PATENT AND TRADEMARK OFFICE

CERTIFICATE OF CORRECTION

PATENT NO. : 5,990,844

DATED : November 23 1999

INVENTOR(S): Bernard DUMONT, et al.

It is certified that an error appears in the above-identified patent and that said Letters Patent is hereby corrected as shown below:

On the title page, item [75] the 4th inventor's name is spelled incorrectly, it should read:

-- [75] Inventors: Bernard DUMONT; Jean CHAMBRUN, both of Paris; Bernard PERRIER, Viry Chatillon; Jacques ROQUENCOURT, Cormeilles En Parisis, all of France --

Signed and Sealed this

Seventeenth Day of April, 2001

*Attest:*

Nicholas P. Godici

NICHOLAS P. GODICI

*Attesting Officer*

*Acting Director of the United States Patent and Trademark Office*